US009541252B2

(12) United States Patent
Kropac et al.

(10) Patent No.: US 9,541,252 B2
(45) Date of Patent: Jan. 10, 2017

(54) CONCENTRIC LIGHTING MODULE WITH CONICAL MIRROR

(71) Applicants: Miroslav Kropac, Ostrava (CZ); Libor Juttner, Novy Jicin (CZ); Tomas Nejezchleba, Novy Jicin (CZ); Ivana Chmielova, Havisov (CZ)

(72) Inventors: Miroslav Kropac, Ostrava (CZ); Libor Juttner, Novy Jicin (CZ); Tomas Nejezchleba, Novy Jicin (CZ); Ivana Chmielova, Havisov (CZ)

(73) Assignee: VARROC LIGHTING SYSTEMS, S.R.O. (CZ)

( * ) Notice: Subject to any disclaimer, the term of this patent is extended or adjusted under 35 U.S.C. 154(b) by 394 days.

(21) Appl. No.: 14/015,276

(22) Filed: Aug. 30, 2013

(65) Prior Publication Data

US 2014/0092615 A1 Apr. 3, 2014

(30) Foreign Application Priority Data

Oct. 3, 2012 (CZ) ..... 2012-676

(51) Int. Cl.
*F21S 8/10* (2006.01)

(52) U.S. Cl.
CPC ..... *F21S 48/236* (2013.01); *F21S 48/2243* (2013.01); *F21S 48/2262* (2013.01); *F21S 48/2287* (2013.01); *F21S 48/24* (2013.01); *F21S 48/234* (2013.01)

(58) Field of Classification Search
CPC .. F21S 48/1241; F21S 48/215; F21S 48/2268; F21Y 2101/02; B60Q 1/44; B60Q 1/34; B60Q 1/56; B60Q 1/442; B60Q 1/26; B60Q 1/302; B60Q 1/2657; F21V 7/0091; F21V 7/0008; F21V 7/0025; F21V 7/0033; F21V 7/0041
USPC ..... 362/511, 498, 499, 540, 541
See application file for complete search history.

(56) References Cited

U.S. PATENT DOCUMENTS 5,845,037 A * 12/1998 Miekis ..... G02B 6/0096 248/58
6,953,271 B2 * 10/2005 Aynie ..... F21S 48/215 362/327
7,134,768 B2 * 11/2006 Suzuki ..... B60Q 1/0052 362/241
7,393,131 B2 * 7/2008 Yu ..... G02B 6/0043 362/619
7,431,481 B2 * 10/2008 Stefanov ..... F21S 48/215 362/327

(Continued)

*Primary Examiner* — Jonk-Suk (James) Lee
*Assistant Examiner* — Mark Tsidulko
(74) *Attorney, Agent, or Firm* — Cantor Colburn LLP

(57) ABSTRACT

A concentric lighting module with conical mirror for creating of a three-dimensional optical effect, especially in the outer brake and tail lights of a motor vehicle, has in the peripheral region of the conical mirror (3) a cylindrical output part (2*c*) of a light guide (2) provided by at least one offset (2*d*) on its outer side, which terminates in an active surface (2*e*) and which couples in the region beyond the conical mirror (3) to the collimator part (2*b*) of the light guide (2), formed by a parabolic collimator and a lens and applied by its input part (2*a*) against the light source (1) of the module, and at the transition between the collimator part (2*b*) and the output part (2*c*) of the light guide (2) the module is provided with a total internal light reflection surface (4), whose bottom part also forms an optical prism (4*a*).

9 Claims, 1 Drawing Sheet

(56) References Cited

U.S. PATENT DOCUMENTS

Figure 1:
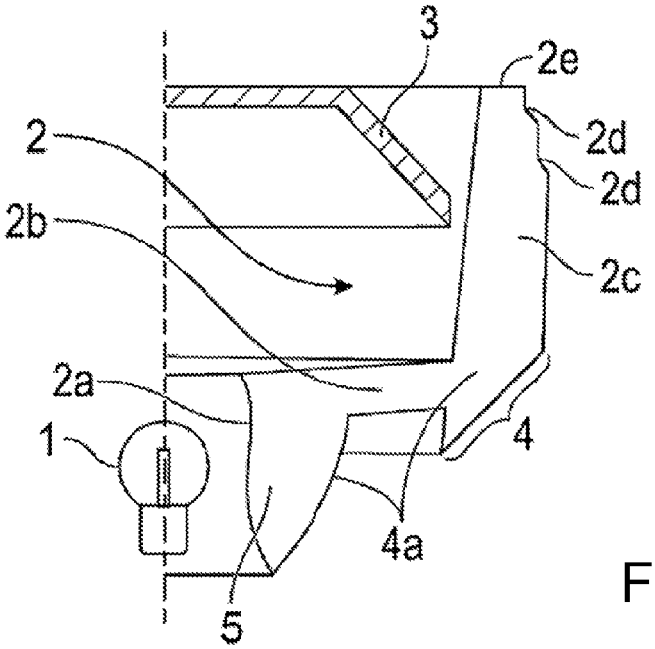

| | | | | |
|---|---|---|---|---|
| 8,434,914 | B2 * | 5/2013 | Li | F21K 9/17 362/307 |
| 8,646,953 | B2 * | 2/2014 | Mochizuki | F21V 7/0008 362/217.05 |
| 8,662,716 | B2 * | 3/2014 | Munro | G02B 19/0028 362/317 |
| 2011/0149585 | A1 | 6/2011 | Dubosc | |

* cited by examiner

CONCENTRIC LIGHTING MODULE WITH CONICAL MIRROR

FIELD OF TECHNOLOGY

The invention concerns a concentric lighting module with conical mirror, to create a three-dimensional optical effect, especially in the outside brake and tail lights of a motor vehicle.

PRIOR ART

At present there is known from the specification of US 2011/0149585 A1 a lighting module designed for the outside rear lighting of a motor vehicle, which creates a 3D optical lighting effect.

This module consists of a curved reflector with a system of openings by which light from light sources is directed both onto a transparent peripheral part of the module arranged in front of the reflector, to create external light traces, and onto the partially transparent (semitransparent metallization) center of the module, which fills the space bounded by the transparent part.

One portion of the light rays emanating from each light source and directed onto the outer edge of the partially transparent middle of the module passes through this partially transparent center and creates a light trace on its outer side. Another portion of the light rays emanating from each light source of the module and directed onto the outer edge of the partially transparent center of the module is reflected by the partially transparent center back onto the reflecting surface of the reflector, from which it is again reflected in the direction of the partially transparent center of the module. One portion of these light rays then passes through the partially transparent center of the module and creates a further light trace on its outer side. Another portion of these rays is reflected by the transparent center back onto the reflecting surface of the reflector. The further path of the light rays on their way to the center of the module is but a repeating of the previous cycle. In this way, one can create several light traces on the outside of the partially transparent center of the module, for example, in the shape of concentric circles, squares, triangles, and so on, with a 3D optical lighting (so-called tunnel) effect.

The drawback of this lighting module is especially its fabrication and material intensity.

ESSENCE OF THE INVENTION

The aforementioned drawbacks are eliminated to a significant degree by the concentric lighting module with a conical mirror for creating of a three-dimensional optical effect, especially in the outer brake and tail lights of a motor vehicle, according to this invention, whose essence lies in that, in the peripheral region of the conical mirror, a cylindrical output part of a light guide is provided by at least one offset on its outer side, terminating in an active surface and coupling in the region beyond the conical mirror to the collimator part of the light guide, formed by a parabolic collimator and a lens and applied by its input part against the light source of the module, and at the transition between the collimator part and the output part of the light guide the module is modified by a total internal light reflection surface, whose bottom part forms an optical channel.

Another essence of this invention is that the conical mirror has its angle of rotation in the range of 1° to 360° and in the cross section drawn by the concentric axis of the module, in the region opposite the offsets of the output part of the light guide, it has the shape of a straight line and/or a concave curve and/or a convex curve, such that it reflects the decoupled light by means of the offsets in the direction of the axis of rotation of the conical mirror.

Another essence of this design of a concentric lighting module with conical mirror is the fact that the light source is an incandescent bulb or a LED diode, and the light guide is formed as a separate part of the module.

Finally, an essence of this invention is the fact that the active light guiding surface of the light guide is supplemented by light scattering elements or speckling or it is formed of scattering material in any given manner, and that light scattering elements in the form of pads and/or strips form the reflecting surface of the light guide.

The advantage of this design is low fabrication and material costs and a better resulting 3D optical light effect.

REVIEW OF FIGURES IN THE DRAWINGS

Figure 2:
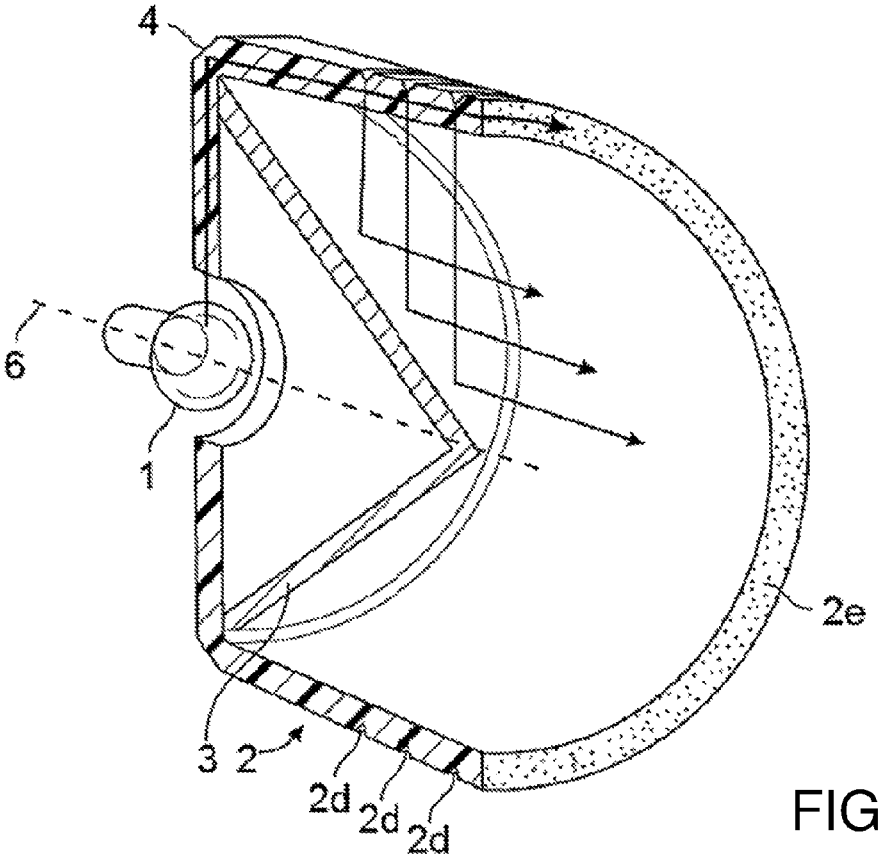

Possible sample embodiments of the concentric lighting module with conical mirror according to this invention are illustrated in the enclosed drawings, where FIG. 1 presents a schematic longitudinal section of the light module, while FIG. 2 is an axonometric view of half of the light module in a specific embodiment showing the path of the light rays.

SAMPLE EMBODIMENTS OF THE INVENTION

As can be seen in FIG. 1, the lighting module with conical mirror for creating a three-dimensional optical effect, especially in the outer brake and tail lights of a motor vehicle, has a cylindrical output part 2*c* of a light guide 2 arranged in the peripheral region of the conical mirror 3 and provided with two offsets 2*d* on its outer side, terminating in an active surface 2*e* to form the outer peripheral light traces. The output part 2*c* of the light guide 2 is then coupled in the region beyond the conical mirror 3 to the collimator part 2*b* of the light guide 2, which is applied by its planar input part 2*a* against the light source 1 of the module, situated in the concentric axis 6 of the module. The light source 1 in the given case is an incandescent bulb, but it can also be replaced by an LED diode.

The transition between the output part 2*c* and the collimator part 2*b* of the light guide 2 is provided with a total internal light reflecting surface 4, whose bottom part forms an optical prism 4*a* of the light guide 2. A lens 5 which is an integral component of the collimator part 2*b* of the light guide 2 focuses the light from the light source 1 on the input surface of the optical prism 4*a*.

The conical mirror 3 in the present case has the shape of a straight line in the cross section drawn through the concentric axis 6 of the module, in the region opposite the offsets 2*d* of the output part 2*c* of the light guide 2. However, the shape of the conical mirror 3 can be modified as needed to the shape of a straight line and/or a concave curve and/or a convex curve, so that it reflects the light decoupled by means of the offsets 2*d* in the direction of the axis of rotation of the conical mirror 3.

Just like the shape of the conical mirror 3 it is also possible to choose the size of its angle of rotation. The lighting module need not always be only one of rotation, but can also have a shape in cross section of a sector of a semicircle, for example, with a center angle of 90° or 120° or 180°. Ultimately, the lighting module need not even be rotational, it can be elliptical, for example, and it is even possible to arbitrarily join together several profile curves.

The function of the individual parts of the lighting module may be understood from FIG. 2.

In advantageous embodiments (not shown), the output part 2*c* of the light guide 2 can be formed, for example, as an independent part of the module separate from the collimator part 2*b* and its active surface 2*e* can be supplemented with light scattering elements or speckling or created from scattering material in any given manner. Light scattering elements in the form of pads and/or strips can also be advantageously provided for the total-reflection surface 4 of the output part 2*e* of the light guide 2.

LIST OF REFERENCE SYMBOLS USED

1—light source
2—light guide
2*a*—input part
2*b*—collimator part
2*c*—output part
2*d*—offset
2*e*—active surface
3—conical mirror
4—total internal reflection surface
4*a*—optical prism

The invention claimed is:

1. A concentric lighting module with a concentric axis and a conical mirror that tapers inwardly along the concentric axis toward an active surface for creating of a three-dimensional optical effect, especially in the outer brake and tail lights of a motor vehicle, wherein in a peripheral region of the conical mirror, a cylindrical output part of a light guide is provided by at least one offset on its outer side, terminating in the active surface and coupling in the region beyond the conical mirror to the collimator part of the light guide, formed by a parabolic collimator and a lens, applied by its input part against the light source of the module, and at the transition between the collimator part and the output part of the light guide the module is provided with a total internal light reflection surface, whose bottom part forms an optical prism, and wherein light rays from the light source enter the lens and collimator part and strike the total internal reflection surface where they are in turn reflected into the cylindrical output part toward the active surface, and wherein a portion of the light rays in the cylindrical output part strike the at least one offset and are reflected onto the conical mirror and in turn reflected outwardly in a direction along the concentric axis of the lighting module and toward the active surface, and wherein the other portion of the light rays in the cylindrical output part pass through the active surface.

2. The lighting module according to claim 1, wherein the conical mirror has its angle of rotation in the range of 1° to 360°.

3. The lighting module according to claim 1, wherein the conical mirror has, in the cross section drawn by the concentric axis of the module, in the region opposite the offsets of the output part of the light guide, the shape of a straight line and/or a concave curve and/or a convex curve, such that it reflects the decoupled light by means of the offsets in the direction of the axis of rotation of the conical mirror.

4. The lighting module according to claim 1, wherein the light source is an incandescent bulb or an LED diode.

5. The lighting module according to claim 1, wherein the light guide is formed as an independent part of the module.

6. The lighting module according to claim 5, wherein the active surface of the light guide is supplemented by light scattering elements or speckling or it is formed from scattering material in any given manner.

7. The lighting module according to claim 1, wherein light scattering elements in the form of pads and/or strips form the reflecting surface of the light guide.

8. The lighting module according to claim 1, wherein the at least one offset comprises a plurality of offsets.

9. The lighting module according to claim 8, wherein the plurality of offsets are spaced along the cylindrical output part.

* * * * *